US007582165B2

(12) United States Patent
Bush et al.

(10) Patent No.: US 7,582,165 B2
(45) Date of Patent: Sep. 1, 2009

(54) PHOTORECEPTOR PLUG TO ENABLE UNIVERSAL CHUCK CAPABILITY

(75) Inventors: Steven D. Bush, Red Creek, NY (US); Peter J. Schmitt, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 519 days.

(21) Appl. No.: 11/096,019

(22) Filed: Mar. 31, 2005

(65) Prior Publication Data

US 2006/0218807 A1 Oct. 5, 2006

(51) Int. Cl.
*B05C 13/00* (2006.01)

(52) U.S. Cl. ..... 118/503; 118/423; 118/505

(58) Field of Classification Search ..... 118/503, 118/423, DIG. 12, DIG. 11, 504–505; 279/2.17, 279/2.22

See application file for complete search history.

(56) References Cited

U.S. PATENT DOCUMENTS 4,265,990 A 5/1981 Stolka et al.
4,390,611 A 6/1983 Ishikawa et al.
4,551,404 A 11/1985 Hiro et al.
4,588,667 A 5/1986 Jones et al.
4,596,754 A 6/1986 Tsutsui et al.
4,797,337 A 1/1989 Law et al.
4,820,246 A * 4/1989 Allen ..... 474/174
4,879,158 A * 11/1989 Horiki et al. ..... 428/159
5,226,196 A * 7/1993 Humlan ..... 4/295
5,320,364 A * 6/1994 Mistrater et al. ..... 279/2.17
5,433,782 A * 7/1995 Filbert et al. ..... 118/266
5,693,372 A 12/1997 Mistrater et al.
5,725,667 A 3/1998 Petropoulos et al.
5,788,774 A 8/1998 Mccumiskey et al.
5,829,759 A 11/1998 Swain et al.
5,829,760 A 11/1998 Mistrater et al.
5,895,529 A 4/1999 Foley et al.
6,214,419 B1 4/2001 Dinh et al.
6,562,135 B2 * 5/2003 Bush et al. ..... 118/407

* cited by examiner

*Primary Examiner*—Brenda A. Lamb
(74) *Attorney, Agent, or Firm*—Pillsbury Winthrop Shaw Pittman LLP

(57) ABSTRACT

An assembly and method is described as employing a polymeric plug member. The plug member is used in the bottom portion of a photoreceptor drum to prevent leakage of the coating solution into the interior of a photoreceptor drum during dip-coating.

10 Claims, 2 Drawing Sheets

PHOTORECEPTOR PLUG TO ENABLE UNIVERSAL CHUCK CAPABILITY

BACKGROUND

All references cited in this specification, and their references, are incorporated by reference herein in their entirety where appropriate for teachings of additional or alternative details, features, and/or technical background.

Disclosed in the embodiments herein is an improved process related in general to immersion coating of electrostatographic imaging drums, and more particularly, to compressible plugs for prevention of leakage of coating solution inside such a drum. Moreover, the new plug allows use of a universal chuck connected to a carrier for transporting the drum through the coating and drying process.

Electrophotographic imaging members are known. Electrophotographic imaging members include photosensitive members, known as photoreceptors. Photosensitive members commonly utilized in electrophotographic (xerographic) processes may comprise, for example, a flexible belt or a structure such as a rigid drum.

Rigid electrophotographic imaging members, including drums, may be coated by many different techniques such as spraying coating or immersion or dip coating. Dip coating is a coating method typically involving dipping a substrate in a coating solution and taking up the substrate for the drying step. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed.

One method for dip coating electrophotographic cylinders or drums comprises obtaining a drum having an outer surface to be coated, an inner surface wall defining a void, and an upper opening end and a lower opening end in communication with the void, immersing the drum in a flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, and withdrawing the drum from the coating vessel.

An electrophotographic receptor drum may have the form of a relatively narrow cylinder or tube. As coating of only the outside of a photoreceptor drum may be desired, in particular to avoid loss of the coating solution, a plug may be affixed at the top end of an electrophotographic drum before the immersion into the coating substance to prevent the coating substance from entering the void due to positive air pressure therein. A chuck member may be relied upon both to seal the top of the photoreceptor drum to prevent fluid from entering the opening in the drum by displacing air in the opening (i.e., the chuck member acting as a plug) and also carry it through this entire operation. The chuck may have a seamless plug shape to prevent the coating solutions from penetrating inside the drum by air leaking along the seam. The chuck device may be configured to have a stem portion anchored in the plug portion. The plug portion is inserted in the open top end of the photoreceptor drum to connect it firmly to a carrier assembly for transporting the photoreceptor through the coating and drying operation.

In one process, an air cylinder is used to compress a spring-loaded shaft. The shaft is extended in a downward motion. This motion stretches a sealing bladder chuck. The stretching decreases the outside diameter of the bladder. Thinning of the bladder allows the substrate, i.e. the photoreceptor drum, to be lifted into position against a horizontal shoulder. The placement against the shoulder ensures that the drum is at a nearly perfect vertical position. Once in position the air cylinder is lifted up and the bladder is forced to compress by the spring-loaded shaft. This expansion secures the photoreceptor to the carrier for the duration of the coating process. The air pressure inside the cylinder is intended to counter the penetration flow of the coating solution. Unchucking is simply the reverse operation.

The use of a single rubber bladder for sealing the drum and for moving the drum from one process step to another has worked very well over the years but has the disadvantage of not allowing different diameters of photoreceptors to be coated using a single chuck. In fact, the solid or inflatable chuck system requires a specifically fitted single chuck for each of the different size diameter drums. As a consequence, multiple diameter photoreceptors cannot be treated and transported through the same installation. As part of the task of coating different diameter photoreceptors, a plant operation requires that the individual chucks must be continually exchanged or "changed out", commensurate with the size and number of the different photoreceptor tubes. This complicated aspect of the operation of the coating/drying process can be very time-consuming as well as adding to the cost of such a facility by the requirement of a great number of differently sized chucks.

There is a labor cost in changing chucks from one diameter to the next. There is also a material loss expected in changing out chucks due to incorrectly installed chucks resulting in the simultaneous loss of several photoreceptor drums and down time required for repair and recovery. In the prior art, there is also known special sound-absorbing members, intended purely for acting as silencers, that are inserted into a drum to reduce sound that may be caused by a drum. The incorporation of silencers adds additional manufacturing costs. Thus there is a disadvantage of using a sealing chuck assembly that fits only one specific size diameter photoreceptor drum.

REFERENCES

Patents which disclose dip-coating a rigid cylindrical assembly with an electrophotographic coating solution are known. For example, illustrated in U.S. Pat. No. 5,788,774 to Mccumiskey et al., issued Aug. 4, 1998, is a substrate coating assembly employing a plug member for selectively coating a hollow cylindrical substrate wherein the plug member is fabricated from a non-wetting material.

U.S. Pat. No. 5,693,372 to Mistrater et al., issued Dec. 2, 1997, describes a process for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

U.S. Pat. No. 5,725,667 to Petropoulos et al., issued Mar. 10, 1998, discloses a dip coating apparatus including: (a) a single coating vessel capable of containing a batch of substrates vertically positioned in the vessel, wherein there is absent vessel walls defining a separate compartment for each of the substrates; (b) a coating solution disposed in the vessel, wherein the solution is comprised of materials employed in a photosensitive member and including a solvent that gives off a solvent vapor; and (c) a solvent vapor uniformity control apparatus which minimizes any difference in solvent vapor concentration encountered by the batch of the substrates in the air adjacent the solution surface, thereby improving coating uniformity of the substrates.

U.S. Pat. No. 6,214,419 to Dinh et al., discloses a process for immersion coating of a substrate including positioning a substrate having a top and bottom within a coating vessel having an inner surface to define a space between the inner surface and the substrate, filling at least a portion of the space with a coating mixture; stopping the filling slightly below the top of the substrate, initiating removal of the coating mixture at a gradually increasing rate to a predetermined maximum flow rate in a short predetermined distance, and continuing removal of the coating mixture at substantially the predetermined maximum flow rate to deposit a layer of the coating mixture on the substrate.

Coating mixtures in dip coating may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337.

SUMMARY

Aspects of the present invention disclosed herein include an assembly comprising a cylinder-like member having an internal circumferential wall surrounding a void, a bottom opening end and a top opening end, both in communication with said void, a flexible compression-resilient polymeric plug member comprising a closed-cell foam silicone rubber plug nor bladder, or a closed-cell polyethylene foam plug or bladder, sealingly affixed in the bottom opening end so as to prevent leakage into the void when said cylinder is immersed into an electrophotographic coating solution.

By "cylinder-like" it is meant to include cylinder shapes and near cylinder shapes.

Aspects of the present invention disclosed herein further include an assembly comprising a cylinder-like member having a chuck member attached at the top end of the cylinder, the chuck member connected to a carrier member.

Further aspects of the present invention disclosed herein includes a multiple stepped diameter chuck.

Further aspects of the present invention disclosed herein include a method of forming an assembly comprising obtaining a cylinder-like member having an internal circumferential wall defining a void, a bottom opening end and a top opening end, both in communication with said void, and inserting a compressible resilient polymeric plug member, such as closed-cell foam silicone rubber or closed-cell polyethylene foam, into the bottom end of the cylinder-line member in a manner to form an airtight seal at the bottom end of said cylinder-like member.

Additional aspects disclosed herein include a method of attaching a chuck member at the top end of the cylindrical assembly for connecting the substrate assembly to a carrier means; wherein the chuck member may include a multiple stepped diameter chuck.

DETAILED DESCRIPTION

Figure 1:
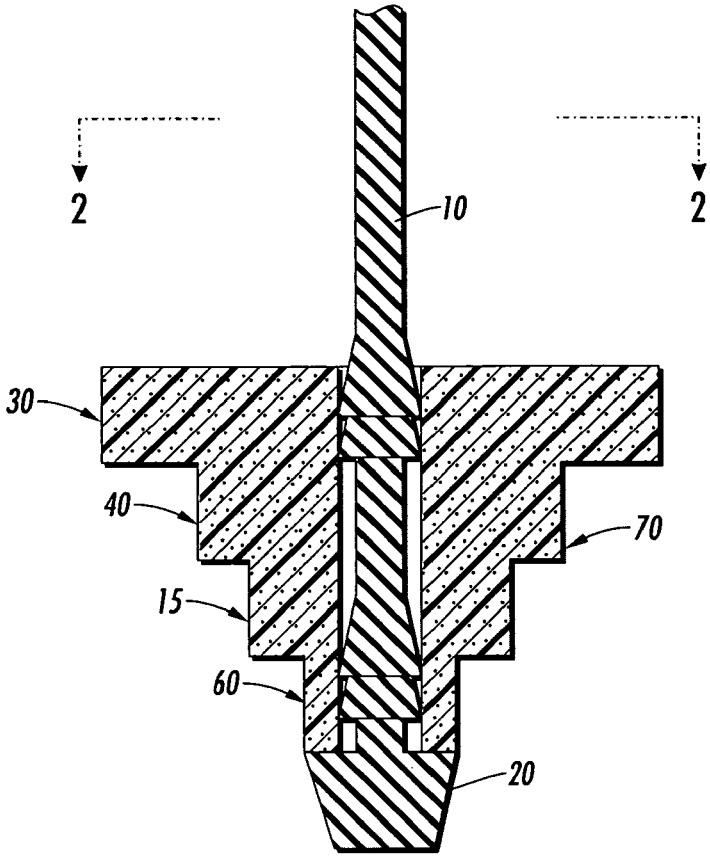
FIG. 1 depicts a cross-section of a universal chuck assembly for lifting and moving cylinder-like electrophotographic imaging members.

In embodiments there is illustrated an assembly comprising a cylinder-like member having an internal circumferential wall defining a void, a bottom opening end and a top opening end, both in communication with said void, a flexible compression-resilient polymeric plug member comprising a closed-cell foam silicone rubber bladder, or a closed-cell polyethylene foam plug or bladder, sealingly affixed in the bottom opening end so as to prevent leakage into the void when said bottom opening portion of said cylinder is immersed into an electrophotographic coating solution.

One embodiment provides a photoreceptor drum comprising internal side walls defining a through void, a bottom opening portion and a top opening portion in communication with said void, a plug at the bottom opening end of the photoreceptor drum comprising a compression resilient polymer positioned so as to seal the bottom end of the cylindrical photoreceptor drum and prevent leakage into the void of the photoreceptor drum during immersion/dipping of the bottom end of the drum into a coating solution. There is also provided a chuck member that may be inserted into the top end of the cylindrical photoreceptor member, the chuck comprising an extended stem member in connection to a carrier device.

Another embodiment of the present invention provides a compression-resilient, inert polymeric plug member configured to fit the inside diameter of a specific drum cylinder having internal walls defining a through void and to seal the internal through void of the cylinder against solvent penetration.

It is another embodiment of the present invention to provide a compression-resilient, inert polymeric plug member dedicated to fit and seal a drum cylinder of a specific inside diameter, wherein the inert polymer comprises a silicone.

It is another embodiment of the present invention to provide a compression-resilient plug member comprising a closed cell polyethylene or closed cell silicone foam rubber body that is capable of sealing the bottom of a drum cylinder placed into a coating solution. Moreover, the polymeric plug may be designed to remain in the drum bottom permanently.

It is another embodiment of the present invention to provide the coating assembly wherein a non-sealing universal chuck stem is stepwise shaped to fit the opening top of drum cylinders of different size diameters in a manner to permit lifting and moving of the drum cylinders.

It is a further embodiment of the present invention to provide a universal chuck comprising three to six step-increased diameters.

It is yet another embodiment of the present invention to provide also a method of immersion coating a photoreceptor drum that includes obtaining a photoreceptor drum having internal walls defining a through void, inserting a plug member into the bottom end of said drum, wherein the plug member compression-resiliently seals the bottom end; inserting in the top end of the drum a universal chuck member comprising stepwise increasing diameters and a chuck stem for attachment to a carrier member; immersing said photoreceptor drum sealed bottom end into a photoreceptor coating solution; withdrawing said photoreceptor drum from the coating solution; and transporting the photoreceptor drum to a drying installation by means of the carrier member.

In particular, aspects of the present invention provide a coating assembly that facilitates sequential coating of multiple diameter size photoreceptor drums using a universal stepped chuck for transport through the coating operation and subsequent drying operation. The improved coating assembly is enabled by sealing the bottom end of the cylindrical photoreceptor drum with an inert compressible polymeric plug capable of preventing the coating solution from leaking into the interior of the drum. Moreover, sealing off the interior of the drum at the lower or bottom end of the drum facilitates the use of a non-sealing mechanical chuck member at the opposite top end as a simple means for connecting to a carrier member.

In one embodiment of the invention the incorporation of a closed-cell foam silicone plug into the bottom aperture of a cylinder-like photoreceptor prevents the photoreceptor coating solution from entering the void in such photoreceptor drum when the bottom of the drum is dipped into the coating solution but also permits the use of a chuck positioned in the top portion of the void (top end of the cylinder-like photoreceptor) to grasp and move the photoreceptor without the need of such chuck to provide an airtight or hermetic seal to keep fluid out of the void. The application of universal chucks extends the process capability of fabrication to allow formation of a coating on a number of different diameter drums without the need for an expensive changeover operation or other added costs.

The primary requirement of a plug of the present invention is to provide a tight seal at the bottom of the drum during processing so as to keep the coating solvent from penetrating the inside of the drum during dip coating. The compressible polymeric plug which may comprise closed cell silicone form or a closed-cell polyethylene foam that typically should be able to withstand temperature extremes ranging from about 18° C. to about 185° C. and to weather extensive exposure to strong organic solvents, such as tetrahydrofuran and toluene, without degrading or compromising its ability to seal the drum opening.

The fact that the photoreceptor plug enables the use of a non-sealing chuck may be considered a great improvement in terms of time and cost in the manufacture of organic polymer coated photoreceptors of various diameters. Considerable time may be saved by eliminating the need for engaging maintenance to change over ca. 1000 chucks. Risk of malfunctioning equipment can be significantly lowered by the present invention since every such chuck change carries always the possibility of encountering loose hardware or a chuck that is not seated properly to the face of the carrier. Potential savings may be accrue from the fact that the plug enables employing a universal chuck, such that changeovers of chuck members are not required for coating different diameter photoreceptor drums.

In one embodiment of a universal stepped chuck, a chuck design may use a closed-cell foam silicone rubber bladder, or a closed-cell polyethylene foam bladder, to perform two tasks—sealing the drum and acting as a carrier for movement of the drum. The first is to seal the photoreceptor internally. The second is to hold the photoreceptor onto the chuck stem during the coating and drying operations. Such step and shoulder provides a required surface area for chucking and alignment. The universal chuck embodiments can be selected to accommodate the various possible combinations of photoreceptor diameters. As an example, stepped shoulders for the system can be selected to fit 20, 24, 27, 30, 40, 47, and 60 mm photoreceptors.

A second potential benefit of the new plugs may lie in the plugs as possible replacement of drum silencers currently used in some of the drums. Thus, it is particularly envisioned that the silicone plug could also function as a drum silencer, thereby replacing current silencers. A plug member of the present invention may remain in the drum permanently.

By eliminating the need for the chuck to hermetically seal the top of the photoreceptor cylinder/drum in dip coating, a whole new generation of photoreceptor chucks can be introduced. A chuck member may be capable of holding numerous diameter sized photoreceptor cylinders or drums. Such a chuck may be referenced as a universal chuck which may include a stem shaped in step increments of appropriately different diameters to fit the different size ends of the photoreceptor cylinders. A stepped universal chuck may enable the coating assembly to coat different diameter photoreceptors without the need for a chuck or carrier changeover.

The following figures are being submitted to illustrate the embodiments but are not intended to limit the scope of the present invention.

FIG. 1 depicts a cross-section of a universal stepped chuck assembly 70; the chuck showing three steps of increasing ring width or diameter from the smallest 60 adjacent to chuck nose portion 20, to 15, and intermediate or larger diameter 40, concentrically enclosing the chuck stem portion 10 in the center. The topmost ring 30 of the chuck assembly 70 is a cover portion of overall diameter 2. Another embodiment of the universal chuck assembly provides an O-ring gasket (not shown) around each step diameter.

Figure 2:
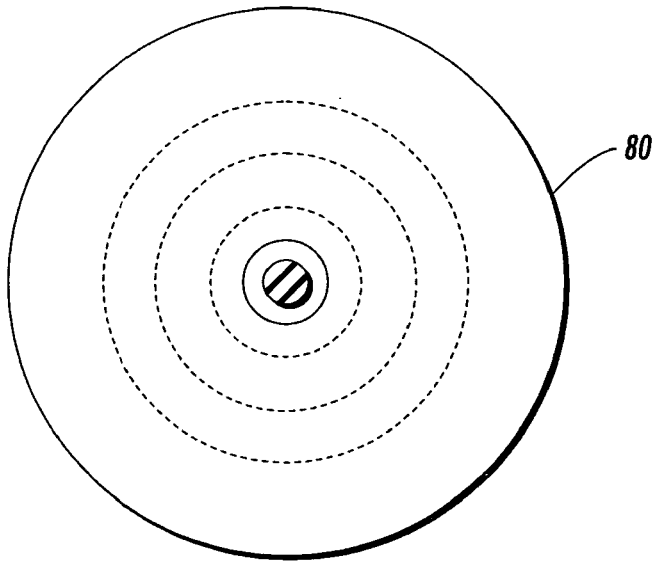
FIG. 2 depicts a top view of the universal chuck assembly of FIG. 1.

FIG. 2 depicts a top view of chuck 80 indicating the three step increased rings and the round cover portion.

Figure 3:
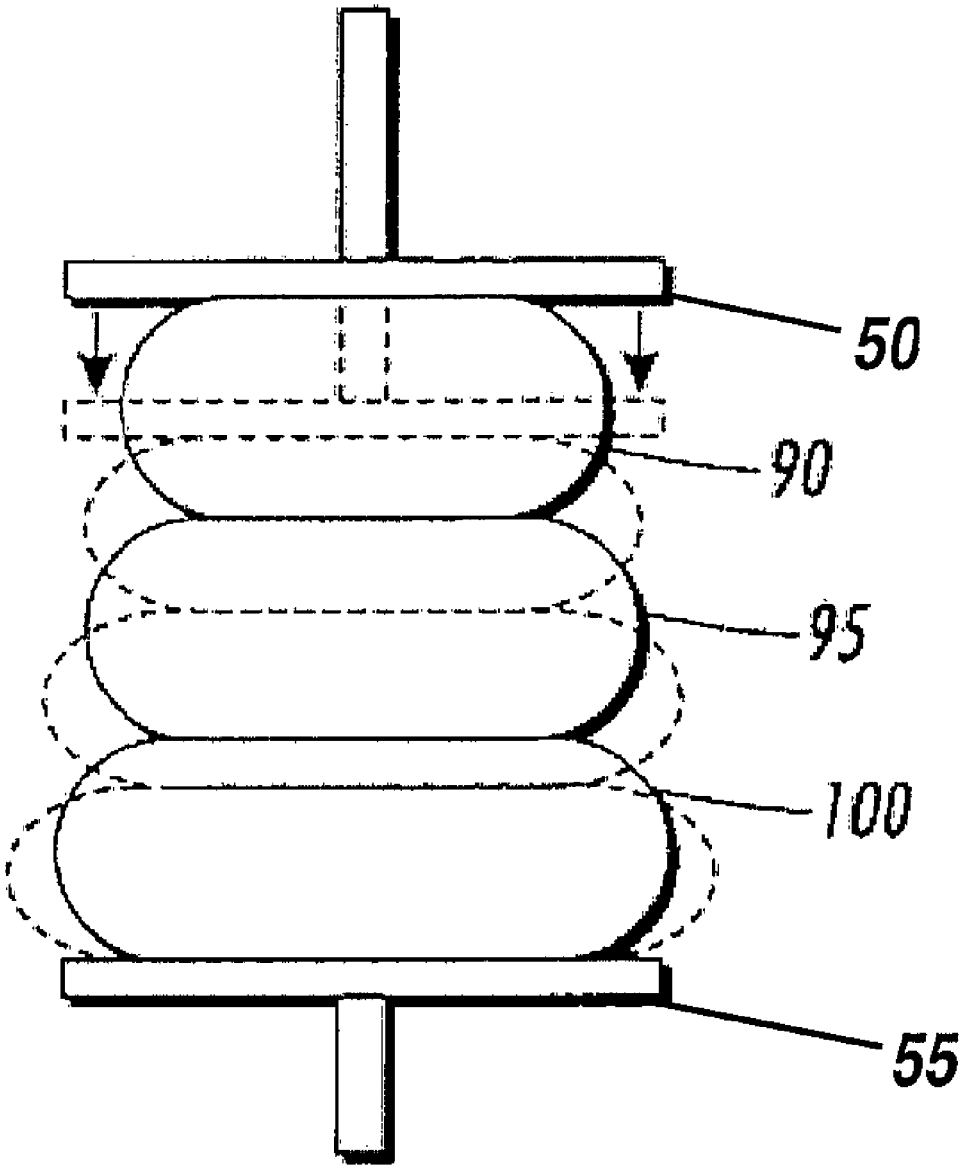
FIG. 3 depicts three different size compressible resilient polymeric plugs under different degrees of compression.

FIG. 3 is a drawing of three adjustably compressible sealing plugs 90, 95, and 100, showing compression of each as a force is applied to a leading end 50 in a direction toward second end 55 shown by the arrows in the FIG. (as shown by the phantom plugs in the Figure). Moreover, a preferred embodiment of the plug can be locked in a compressed position. One preferred locking mechanism includes a twist lock. The plug may comprise, for example, closed-cell foam silicon tuber or a closed-cell polyethylene foam. The durometer of the material is in a range selected so as to keep the material as light and soft as possible, but still able to provide a robust sealing effect. The plug may comprise different stepped diameters; for example each of plugs 90, 95, and 100 can be adjoined to one another along a surface or molded as a single piece with different stepped diameters along the vertical axis. This permits one plug to be used to plug different diameter sized drums.

For the purpose of permanent installment of the sealing plug, one embodiment utilizes silicone as base material. Silicone rubber has been shown to be resistant to temperatures of up to about 185° C. No degradation of the material can be found after exposures to tetrahydrofuran and toluene, and similar solvents known in this art, for periods greater than twelve hours. Testing using samples cut from closed-cell foam sheet silicone rubber in 30 mm diameter photoreceptors showed that the plugs allow little, if any, coating solution from impinging on the internal surface of the drum when the photoreceptors are coat dipped.

The inventive silicone foam plug meets the sealing requirement, which allows selection of the stepped chuck on the basis of having only to provide for holding and locating the pipe.

Example 1

Electrical Results

Test drums comprising end hermetically-plugged photoreceptor drums (at the bottom end) were compared to photoreceptor drums hermetically sealed by a chuck at the top end. Drums were dipped into a photoreceptor solution and then processed to provide dry coated photoreceptor drums. The dry drums were then electrically tested. Electrical results showed a delta of ~3V for all drums, well within the expected range in manufacturing a batch of dip coated drums.

In a practical application, the use of the desired plugs may obviate the need for silencers to be placed in the drums during the manufacturing process, while still meeting desirable goals for noise reduction. The shape, durometer, and weight of the stopper or bladder can be changed to match that of the silencer to avoid the need to utilize a separate silencer.

While the invention has been particularly shown and described with reference to a particular embodiment, it will be appreciated that various of the above-disclosed and other features and functions, or alternatives thereof, may be desirably combined into many other different systems or applications. Also that various presently unforeseen and unanticipated alternatives, modifications, variations, or improvements therein may be subsequently made by those skilled in the art which are also intended to be encompassed by the following claims. Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A universal chuck assembly for supporting an imaging drum during a coating process, the drum comprising a cylinder-like member having an internal surface defining a void, a bottom opening end and a top opening end, both of said openings in communication with said void, said universal chuck assembly comprising:

a compression-resilient polymeric plug assembly configured to be sealingly affixed in said bottom opening of said cylinder-like member to prevent leakage into the void of the cylinder-like member when said bottom opening end is immersed into an electrophotographic coating solution, said polymeric plug assembly comprising a combination of a locking mechanism and a compression-resilient polymeric composite plug, the composite plug formed by adjoining separate plugs along a surface; the composite plug having a plurality of sealing portions as defined by outermost side edges of the separate plugs, each of said sealing portions having different stepped diameters; wherein the locking mechanism acts upon the composite plug so as to compress the composite plug in a manner such that a portion of the outermost side edges of at least one of the plurality of sealing portions of the composite plug curves outwardly, so that an outwardly curved portion of the side edges of the composite plug sealingly engages the internal surface of the void, the diameters of said sealing portions progressively increasing away from a leading end thereof, and a chuck member affixed in said internal surface of the void at said top opening end of said cylinder-like member, wherein the chuck member comprises step members of different sized diameters progressively increasing away from a leading end thereof.

2. An assembly according to claim 1, wherein the composite polymeric plug comprises closed-cell polyethylene foam.

3. An assembly according to claim 1, wherein the composite polymeric plug comprises a silicone compound.

4. An assembly according to claim 3, wherein the silicone compound comprises a closed cell foam silicone polymer.

5. An assembly according to claim 3, wherein the silicone compound is resistant to a temperature ranging from about 18° C. to about 185° C.

6. An assembly according to claim 1, wherein the cylinder-like member of the drum comprises a diameter of 20, 24, 27, 30, 40, 47, or 60 mm.

7. An assembly according to claim 1, wherein the chuck member comprises diameters selected from the group consisting of 20, 24, 27, 30, 40, 47, or 60 mm.

8. An assembly according to claim 7, wherein a number of, step members comprises six (6).

9. An assembly according to claim 1, wherein a stem portion of the chuck member is configured as an attachment.

10. An assembly according to claim 1, wherein the composite polymeric plug comprises three (3) sealing portions.

* * * * *